United States Patent [19]

Williamson

[11] Patent Number: 4,814,735

[45] Date of Patent: Mar. 21, 1989

[54] MAGNETIC CORE MULTIPLE TAP OR WINDINGS DEVICES

[75] Inventor: James A. Williamson, Costa Mesa, Calif.

[73] Assignee: Williamson Windings Inc., Santa Ana, Calif.

[21] Appl. No.: 742,589

[22] Filed: Jun. 10, 1985

[51] Int. Cl.[4] ..... H01F 15/10; H01F 27/28

[52] U.S. Cl. ..... 336/192; 336/180; 336/182; 336/223; 336/229

[58] Field of Search ..... 336/221–223, 336/225, 230, 170–173, 182, 183, 188, 65, 192, 186, 220, 225, 180, 229

[56] References Cited

U.S. PATENT DOCUMENTS

| | | | |
|---|---|---|---|
| 316,354 | 4/1885 | Gauland et al. | 336/183 X |
| 777,148 | 12/1904 | Schweitzer | 336/223 X |
| 873,253 | 12/1907 | MacGahan | 336/186 |
| 1,173,094 | 2/1916 | Blume | 336/183 X |
| 1,723,840 | 8/1929 | Burnham | 336/183 X |
| 1,801,214 | 4/1931 | Von Henke | 336/223 |
| 1,852,805 | 4/1932 | Frank | 336/183 |
| 2,061,388 | 11/1936 | Schou | 336/223 X |
| 2,378,884 | 6/1945 | Seifent | 336/223 X |
| 2,474,395 | 6/1949 | Early et al. | 336/183 X |
| 2,535,554 | 12/1950 | Thurston | 336/186 X |
| 2,568,169 | 9/1951 | Raczyuski | 336/223 |
| 2,814,732 | 11/1957 | McFarland | 336/182 X |
| 2,972,713 | 2/1961 | Sutton Jr. | 336/221 X |
| 3,271,716 | 9/1966 | Furth | 336/183 X |
| 4,188,599 | 2/1980 | Papa | 336/223 X |

FOREIGN PATENT DOCUMENTS

| | | | |
|---|---|---|---|
| 1308052 | 9/1961 | France | 336/223 |
| 400275 | 11/1942 | Italy | 336/223 |
| 581514 | 11/1977 | U.S.S.R. | 336/183 |

*Primary Examiner*—Thomas J. Kozma

*Attorney, Agent, or Firm*—James F. Kirk; Wilfred G. Caldwell

[57] ABSTRACT

Windings for magnetic core devices are preformed as a flat conducting strip disposed in a helical coil configuration of circular shape, having elongated tabs at selectible angles to the coil from substantially tangential to substantially radial orientation for cooperation with the magnetic core exit slots, thereby maximizing core window utilization and adapting to conventional cores. The cross sectional area of the tabs may be substantially less than the cross sectional area of helix turns thereby further eliminating interference with smaller core exit slots. A plurality of such windings are stacked, one on top of the other, or interleaved or placed on torroidal core with flexible orientation of the tabs being available to facilitate access to each of multiple terminals and to isolate or group electrical functions.

4 Claims, 8 Drawing Sheets

MAGNETIC CORE MULTIPLE TAP OR WINDINGS DEVICES

FIELD OF THE INVENTION

The devices of the present invention are applicable to various fields employing magnetic core inductor or transformers.

BACKGROUND OF THE INVENTION

Magnetic coils are employed in a wide variety of different applications, such as transformers, electric motors, relays and as inductive impedances. Such coils are currently manufactured in two ways. The first and most common method of coil manufacture is the wrapping of circular copper wire on a bobbin which is then placed on a magnetic core. The other method that is sometimes used is the wrapping of a rectangular copper strip on a bobbin as a spiral wound coil which is then placed on a magnetic core.

Coils formed by the first method are quite readily fabricated but have numerous disadvantages which are overcome by strip wound coils. Thus, because the rectangular strip fits better or tighter on a bobbin, a larger amount of conductor may be wound on a bobbin and internal losses are reduced. Strip wound coils are easier to tap and have better thermal heat conductivity, as well as a lesser danger of arcing because consecutive turns lay next to each other rather than being displaced so that no large voltage exists between turns.

Both wire wound and strip wound coils require bobbins which are disadvantageous both in coil winding and in coil use, and neither readily admits of any modification once a coil is completed.

SUMMARY OF INVENTION

The present invention comprises devices such as inductors and transformers constructed from preformed magnetic coil helix winding adapted to be placed upon a conventional magnetic core for improved performance characteristics. The coil hereof is formed of a material having good electrical conductivity, such as copper, with the conductor having a rectangular cross section, and preferably elongated integral tabs. The conductor is preformed into a helical coil configuration which is circular having an opening to receive the core upon which it is adapted to fit.

By preforming the coil windings of the present invention, it is possible to shape and complete the coil separately from any support structure, so that coil characteristics are exactly predeterminable and also windings may be readily interchanged on a core. No bobbin or the like is required with the present invention so that substantially the entire winding volume may be employed for conductor instead of some being taken up by a bobbin. Windings of the present invention are designed for optimum operation for the intended applications of stacking on cores, in like or different configurations, as individual inductor coils interleaved or not, as transformer primary or secondary coils, and on toroidal cores as adjacent and spaced apart segment wound higher voltage devices.

The preferred integral tabs may comprise partial or full unwound elongated turns of the coils with the cross sections thereof being less than the cross section of a remaining coil turn, which construction admits of continuous production rather than single coil production, as well as automatic processing or assembly due to stacking and dispensing. The integral tabs are indented and inwardly offset relative to the coil to accommodate core window edges thereby enhancing winding efficiency on the core while enabling parallel tao leads from the same side of the coil to fit printed circuit board receiving slots, avoid snorting and provide aesthetic appeal. In stacking multiple coils, the tabs may be oriented in the same general direction, being spaced apart by terminating the coils at different positions along a turn or orienting the tabs at different angles from the coil opening. Also, adjacent coils may have their tabs respectively oppositely oriented such that the tabs of one coil extend to the right of the core; the tabs of the next coil extend to the left, etc.

The metal of the coil turns (e.g. copper) is annealed to establish malleability thereof which, among other features, permits the helix to be elongated to receive a toroidal core, if desired.

Each coil is preferably compressed, using up to 5 tons of pressure or more, such that a coil of $n+1$ turns in height is compressed to a height of n turns or thereabout, including the tab end turns. Now, the coils stack even better and the window metal efficiency is improved.

The conductor of each coil includes an insulative coating, insulation spacers may optionally be employed. A washer shaped piece of plastic insulating material may be placed between adjacent stacked coils, and between the ends of the coils and the core, or otherwise as desired.

At the present time, there exists an unlimited variety of uses for helical coils in multiple arrangements, and it can now be seen that the present invention offers sufficient variety to fulfill a great many heretofore unfilled uses. Thus, the combination of coils and cores, shown herein admits of modification as to number of coils stacked on each leg or interleaved, and the core configuration, leg configuration, and electrical schematics admit of limitless arrangements due to the modular approaches herein disclosed. Thus, with access to each turn or lead of every coil, any number of such schematics may be configured.

DESCRIPTION OF FIGURES

The present invention is illustrated as to particular preferred embodiments thereof in the accompanying drawings wherein.

DESCRIPTION OF PREFERRED EMBODIMENTS

Figure 3:
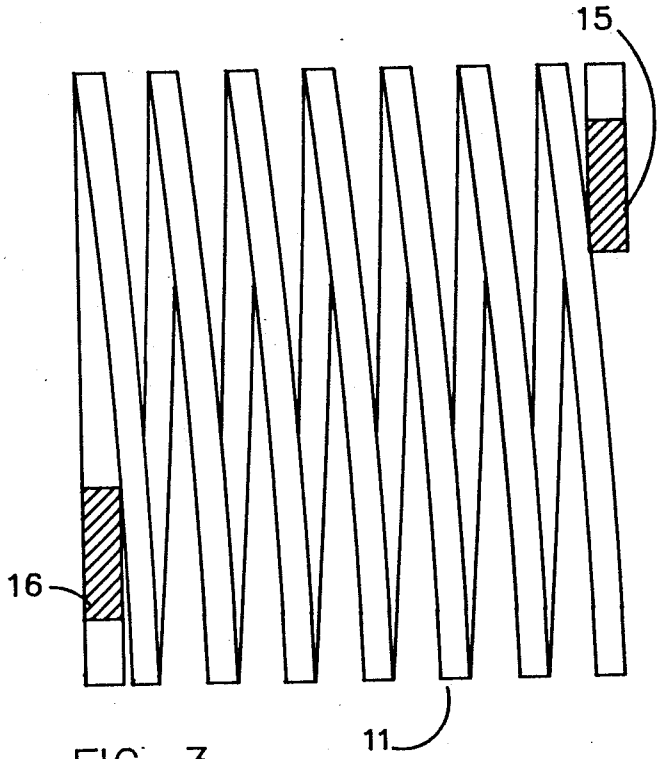
Figure 2:
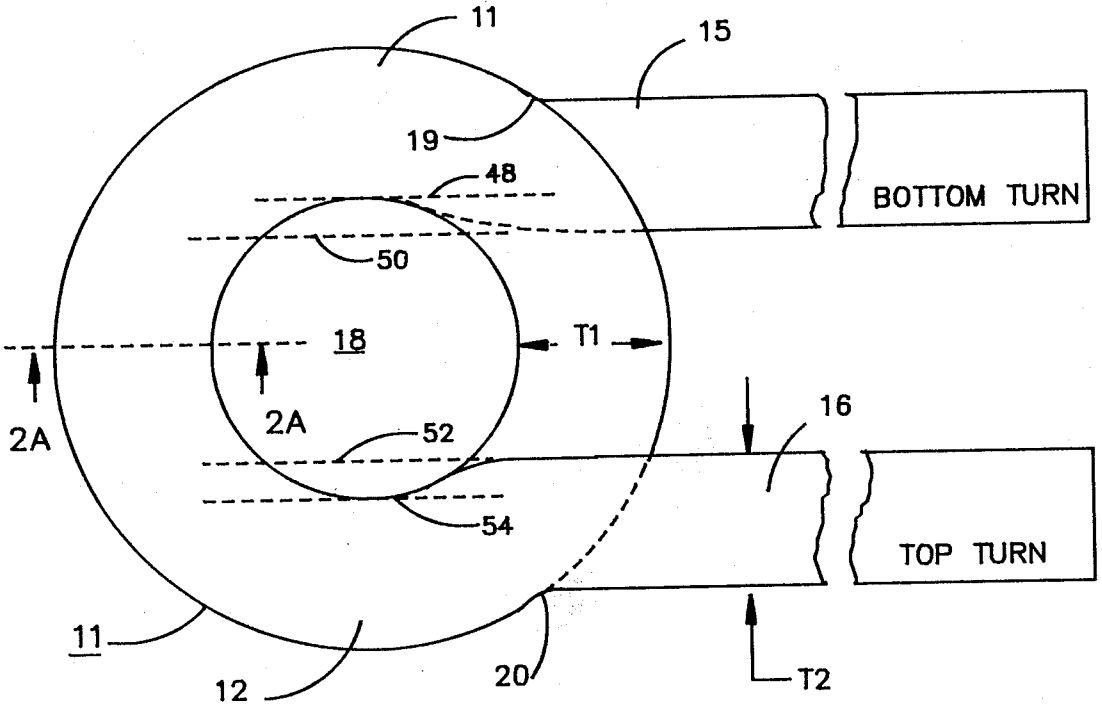
FIG. 2 is a top elevational view of a helical winding with integral tabs, in accordance with the present invention.
Figure 2A:
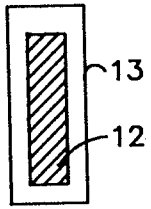
FIG. 2A is a sectional view of an insulated coil turn, FIG. 3 /is a side elevational view of an expanded helical winding with integral tabs in accordance with the present invention.

Preferred embodiments and applications of the present invention are illustrated in the drawings, and referring first to FIG. 2 thereof, there is shown a preformed helical winding, all in accordance with the present invention. This winding 11 is formed of a conductor 12 having a rectangular cross section and coated or otherwise enclosed by an .insulating envelope 13, as indicated in FIG. 2A. The conductor 12 of the winding is formed of a metal having good electrical conducting properties, such as copper or aluminum, and is reformed in the circular helical configuration, best seen in FIG. 3.

Figure 5B:
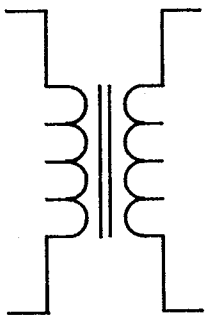
FIG. 5*b* is a schematic of the two stacked compressed coils of the FIG. 5*b* assembly.
Figure 5A:
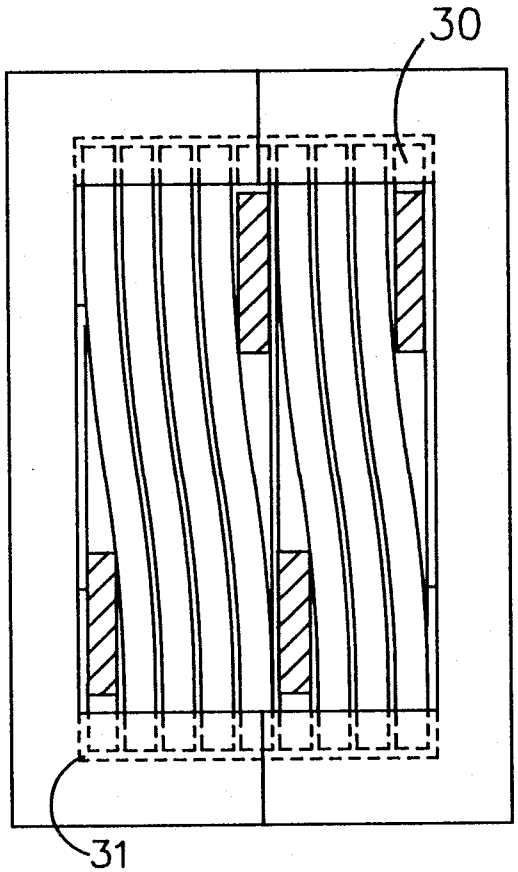
FIG. 5*a* is a side elevational view somewhat corresponding to FIG. 4 but snowing two stacked compressed coils on a single central core leg.
Figure 4:
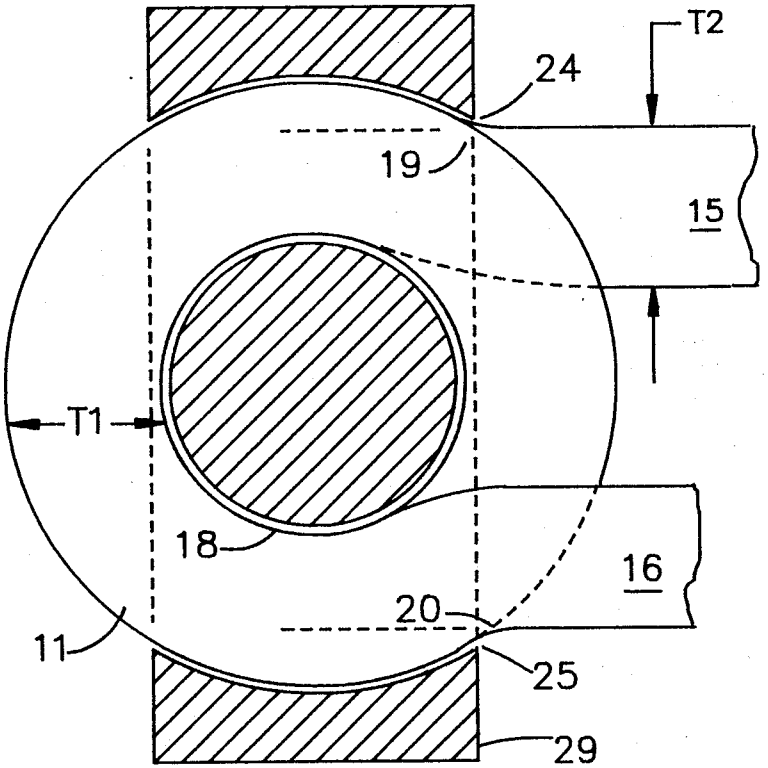
FIG. 4 is a top plan view of the coil mounted on a magnetic core.

FIG. 2 also shows the integral tabs 15 and 16 with cross sectional areas T2, less than the cross sectional area T1, of any turn. The apparent indentations or generally inwardly extending arcuate regions 19, 20 account for the offsets of the tabs from tangents to the central opening 18, such that the arcuate regions 19, 20 may accommodate the vertical edges 24, 25 (FIG. 4) of the core outer leg arcuate portions 30, 31 (FIG. 5). This permits a snug fit (although the spacings are shown exaggerated for clarity) between the coil periphery and the outer leg portions 30, 31, thereby improving magnetic efficiency. The arrangement also enables the coil integral tabs 15, 16 to extend exteriorly from the device, in parallel relation, for slot connection to a circuit board 41, or other mount.

Figure 1:
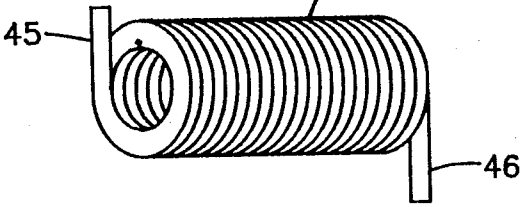
FIG. 1 PRIOR ART
FIG. 1 is a perspective view of a PRIOR ART single helical coil.

A comparison to the PRIOR ART showing of FIG. 1 reveals a helix coil 44 having tabs 45, 46. This is an air core coil which doesn't resolve the magnetic core-type problems, i.e., substantially completely filling the window volume of the magnetic core while offsetting the tabs to accommodate core edges enabling parallel tabs for electrical connections and access space and without causing shorts.

From the Figure, (FIG. 1 PRIOR ART) herein taken from U.S. Pat. No. 999,749 to L. W. Chubb, issued Aug. 8, 1911, it may be seen that the tabs are the same dimensions as the winding turns—no reduced tab cross section nor indented or inwardly arcuate regions being disclosed. Consequently, the tabs are confined to a tangential direction and may not be selectively oriented throughout the angel from tangential to substantially radially, relative to the core opening, as available from the present invention.

In the present invention, this range is available because the integral tab is forced into a hardened guideslot as it is unwound from the coil and the height of the guide slot relative to the gripped coil determines the offset with the amount of turn(s) unwound determining the tab length.

The windings of the present invention have predetermined conductor size and the complete winding for any particular application is formed prior to application to or in cooperation with any type of core structure, so that characteristics, such as window efficiency, and the like, may be determined prior to completion of a magnetic coil. The winding thereof is adapted to be placed upon a magnetic core after completion of the winding which may, of course, be tested and checked prior to incorporation with other elements. The PRIOR ART, being confined to an air core, has not faced these many magnetic problems.

Figure 6:
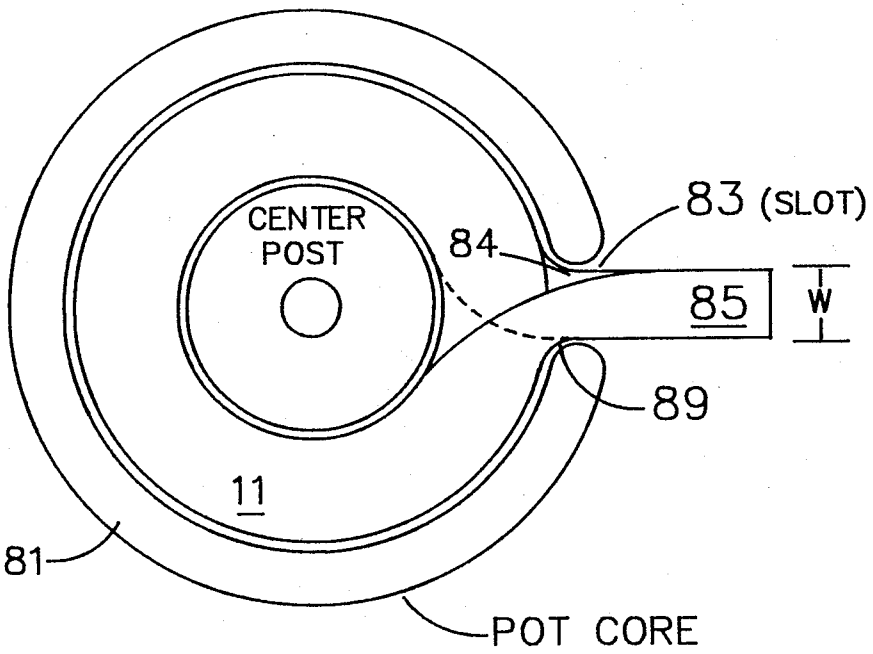
FIG. 6 is a pot core open at the top to show stacked helix coils and integral tabs exiting via the core slot.

In FIG. 6, the lower half of a ferrite pot core is shown at 81, together with helix coil 11. Note the small width slot 83, left in this conventional core, for exit of the integral tab 85. Here, the reduced width "W" of tab 85 enables the necessary exit while the turn width may be substantially wider for efficiency. The "W" dimension is foreshortened by applying heavy pressure to the upper edge of the tab as it is being uncoiled to elongate the same while narrowing its width, which avoids rippling and tearing of the tab. The cross sectional area of the tab is reduced at least 10%, and much more where desired, as in this particular application.

Also, in FIG. 6, the sharp curvature in the inner mouth of the slot 83, due to the shape of the outer core leg, requires a significant inwardly directed arcuate region 89 in tab 85, uniquely achievable by this invention. If the top half of coil 11 were present, it would be seen that the upper tab would exit the same size slot either aligned with or non-aligned with slot 83, but from the opposite direction.

Figure 7:
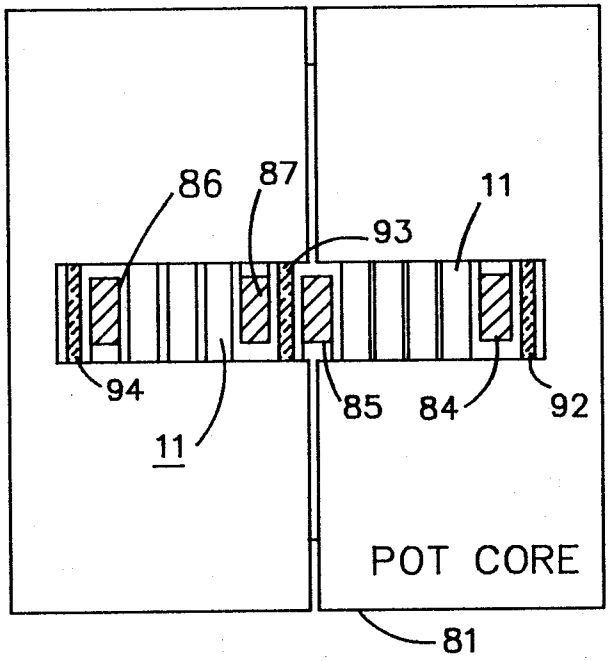
FIG. 7 is a view in side elevation of the structure of FIG. 6.

It may now be appreciated that the prior art coil 44 of FIG. 1 simply could not be adapted to the conventional core 81 of FIG. 7 because the width of its tabs 45 and 46 are exactly the same as the width of its turns. Thus, if small enough leads were employed for exit slot 83, the amount of copper or metal on the core will be atrociously small, and efficiency and performance would be lost. The present invention, through its provisions of the offset 89 and reduced cross sectional area of tab 85 (either by lesser tao width or height), enhances the metal efficiency greatly to make the coil a most desirable element of a multiple winding product. The subject invention, with a directional range of substantially tangential to substantially radial for the tabs relative to the coil openings, permits of multiple coils use with these tiny exit core slots because the tabs may navigate sharp curvatures.

In FIG. 7, spacing apart of tabs 84, 85 for coil 11 and tabs 86, 87 for coil 11' may be seen because a second coil (11') has been stacked on coil 11. Also, the optional insulator layers 92, 93 and 94 are employed in this figure.

Figure 8:
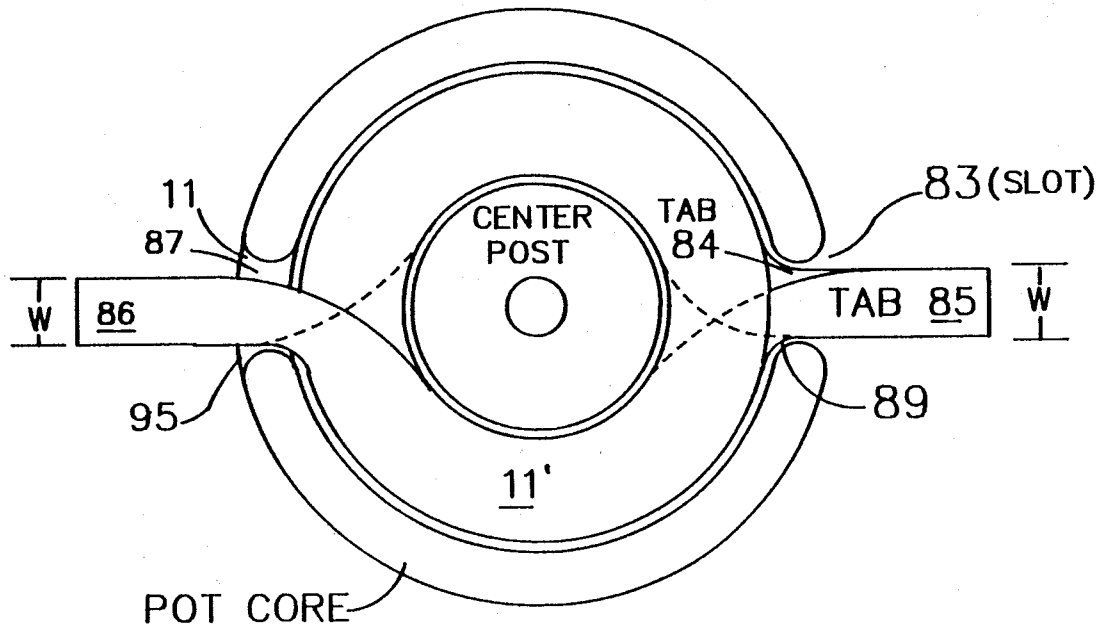
FIG. 8 is a top plan view as in FIG. 6 but showing the tabs of one core exiting a slot 180° removed from the first slot.

FIG. 8 is a top plan view of the two coil structure of FIG. 7, modified to include a further core slot 95 at a location different from slot 83 for exit of coil 11' tabs 86 and 87.

Now, it will be apparent that a large number of helical coils may be stacked on a common core leg or even on different legs to comprise a multiple winding device with access to dozens of tabs. For example, for transformers, all primary tabs may extend in one direction and all secondary tabs in the opposite or different directions such as in FIG. 8. Staggered and spaced leads avoid snort circuits when handling numerous coils.

Figure 9:
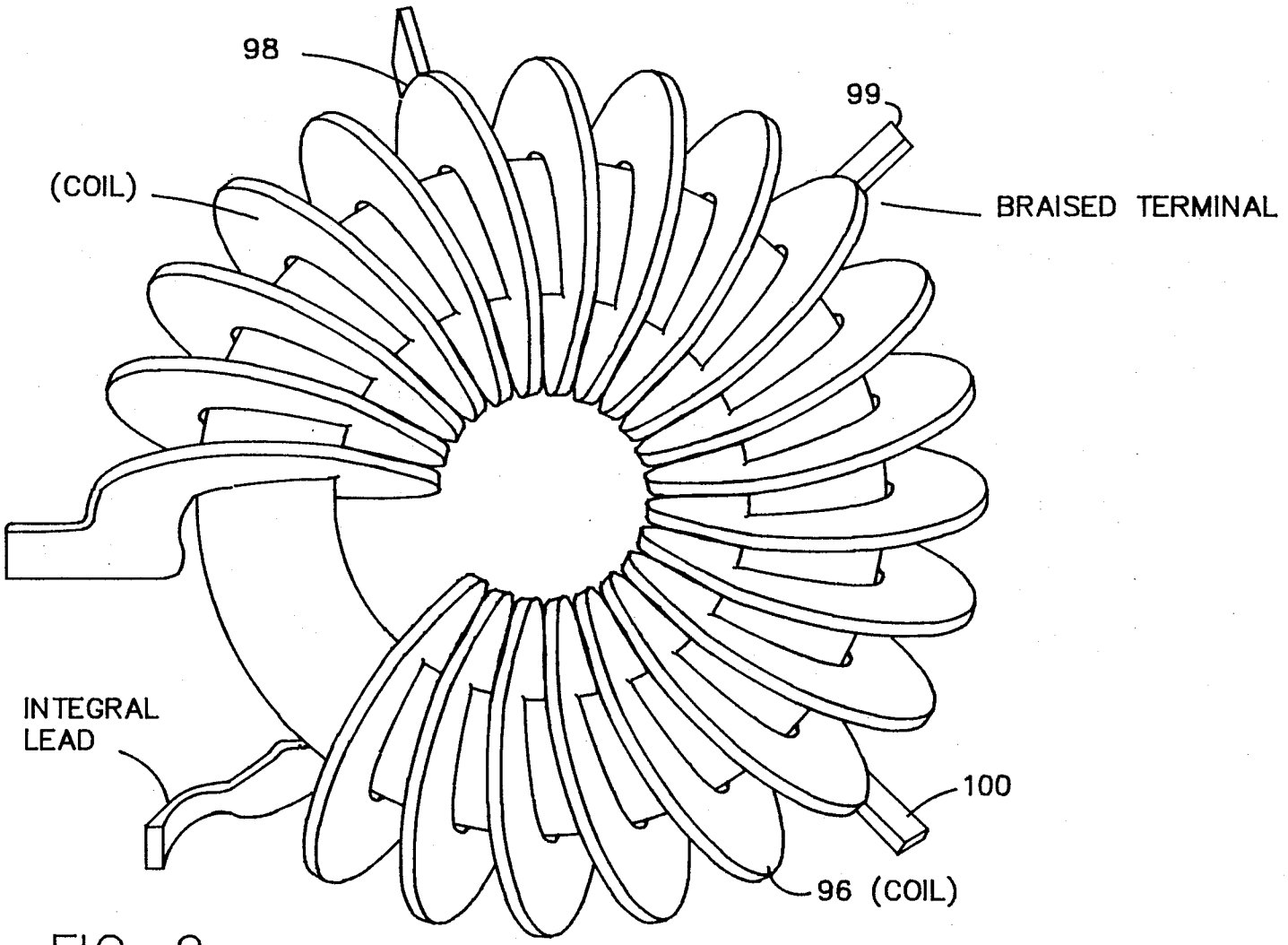
FIG. 9 is a toroidal core with multi-tapped one or more helical coils therein.

FIG. 9 shows a toroidal core 96 with a distributed helical coil 97, in accordance with the present invention, being positioned thereon. Since the metal (e.g. copper) of the helix is malleable following annealing, the turns are separated sufficiently to permit the core to be received in the central opening of the winding 97. Taps 98, 99, and 100 are shown for this single coil, being made by removing the insulation from selected locations on the coil periphery and soldering or braising a lead thereto.

Many advantages of the invention should now be apparent. Additionally, the thermal conductivity is maximized for the evacuation of heat generated in the turns of the windings, particularly, with respect to wire wound coils which have low thermal conductivity in all but the outside turns thereof. It is additionally noted that, as compared to the wire wound coils, the present invention provides adjacent turns of the coil next to each other, so that the voltage between adjacent conductors can be no greater than the voltage generated about a single turn, so as to reduce the possibility of arcing between turns, as well as reducing the amount of charge required to change the voltage on interturn capacitance because of lower voltage swing.

A further, and major advantage, of the present invention is found in the maximization of the amount of conductor that can be placed in any given core or volume, because no bobbin or the like is required in the present invention. At least certain of the foregoing advantages of the present invention are also available with strip wound coils; however, the latter require the inclusion of a bobbin during formation and subsequent use and are not premade or preformed, but instead, are only incorporated as an element in a complete unit including a bobbin upon which the strips are wound.

The electrical winding structure of the present invention is designed for optimum operation, and thus, for example, the primary winding of a transformer is made to fill half the winding window and the other half left for the secondary without regard to the number of turns in each winding or the turns ratio or the number of coils. In addition, the present invention is highly advantageous over prior winding structures from the view point of flexibility. As an example, it is only possible to change the number of turns in a strip wound or wire wound transformer by completely re-designing the transformer and making a new one. On the other hand, a helix wound transformer, in accordance with the present invention, provides the capability of removing the windings and replacing them with new windings having an appropriate number of turns. A further advantage is found in the fact that the windings that have been removed may be re-used.

For square or rectangular coils (not shown), the curved portions of the coils are simply relieved.

To make the inductor of this invention, it is first necessary to form the proper size helical coil.

For forming the helical coils see:

U.S. Pat. No. 368,569 to O. Caldwell Aug. 23, 1887 German AUSLEGESCHRIFT No. 1,177,595 Sept. 10, 1964 German PATENTSCHRIFT No. 562621 Oct. 27, 1932

Next, the coils are annealed in a controlled atmosphere to avoid oxidation, and induce malleability.

Next, the tabbing step, as outlined, supra is performed, followed by applying an insulating coating, such as epoxy.

The coated coil is then ready for installation in the selected magnetic core.

The integral tabs may be directly terminated in any number of connection configurations, other than for board plug-in without resort to any joints, soldering or welding.

Thus, the elongated integral tabs are useful for many other applications, including pending in any type configuration chosen, at adjacent or remote locations, particularly important to custom jobs. The integral tabs may have lengths of 6 to 12 inches, more or less.

Figure 10:
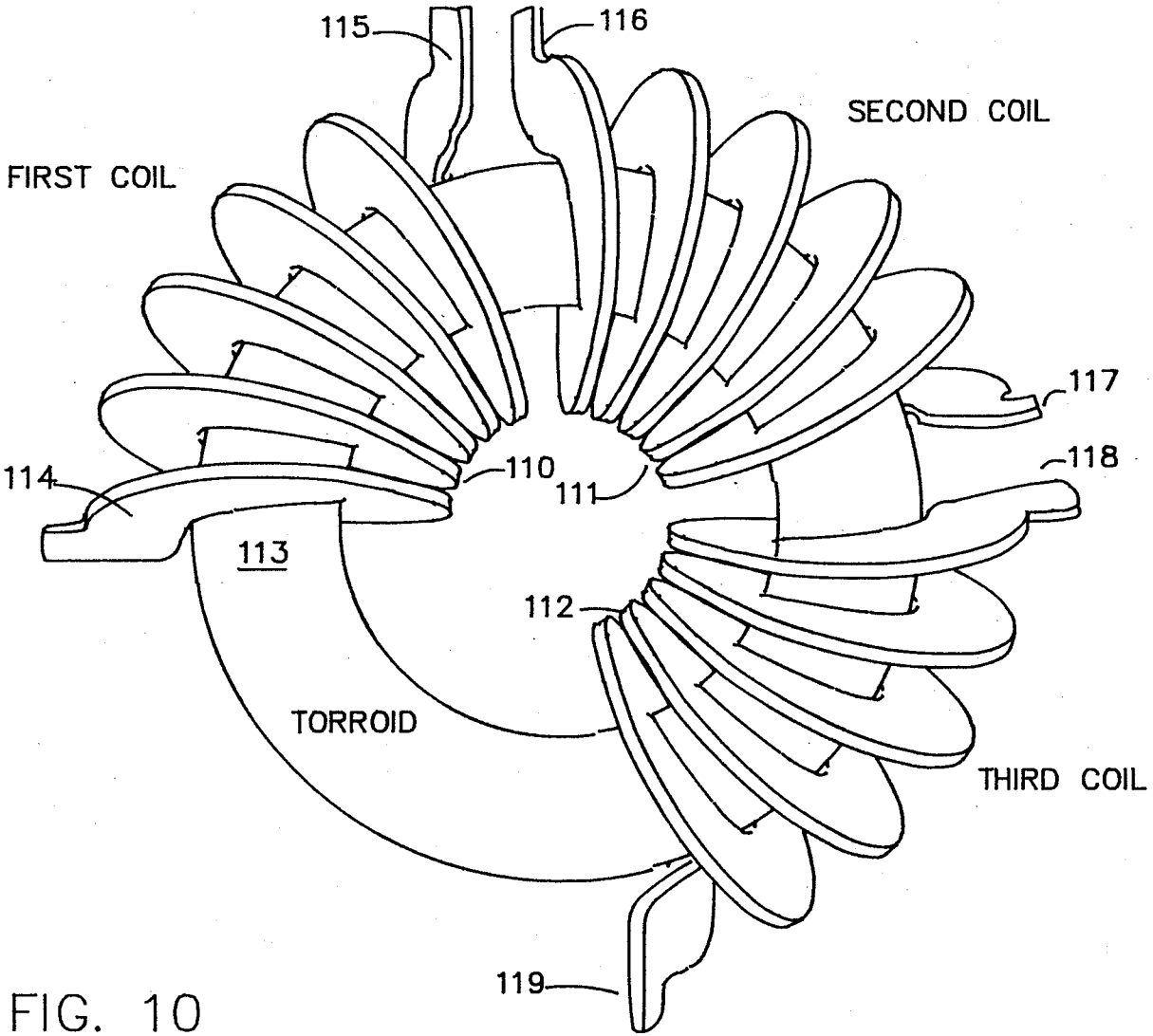
FIG. 10 is a toroidal core with three helix coils being spiralled thereon.

In FIG. 10, three coils 110, 111, and 112 are shown on common toroidal core 113. Coil 110 is shown between tabs 114 and 115; coil 111 includes tabs 116 and 117 and coil 112 has tabs 118 and 119. This configuration is characterized by low capacitance between windings and substantially reduced interturn snorts. Also, note that taping is not required between coils or layers.

Figure 11:
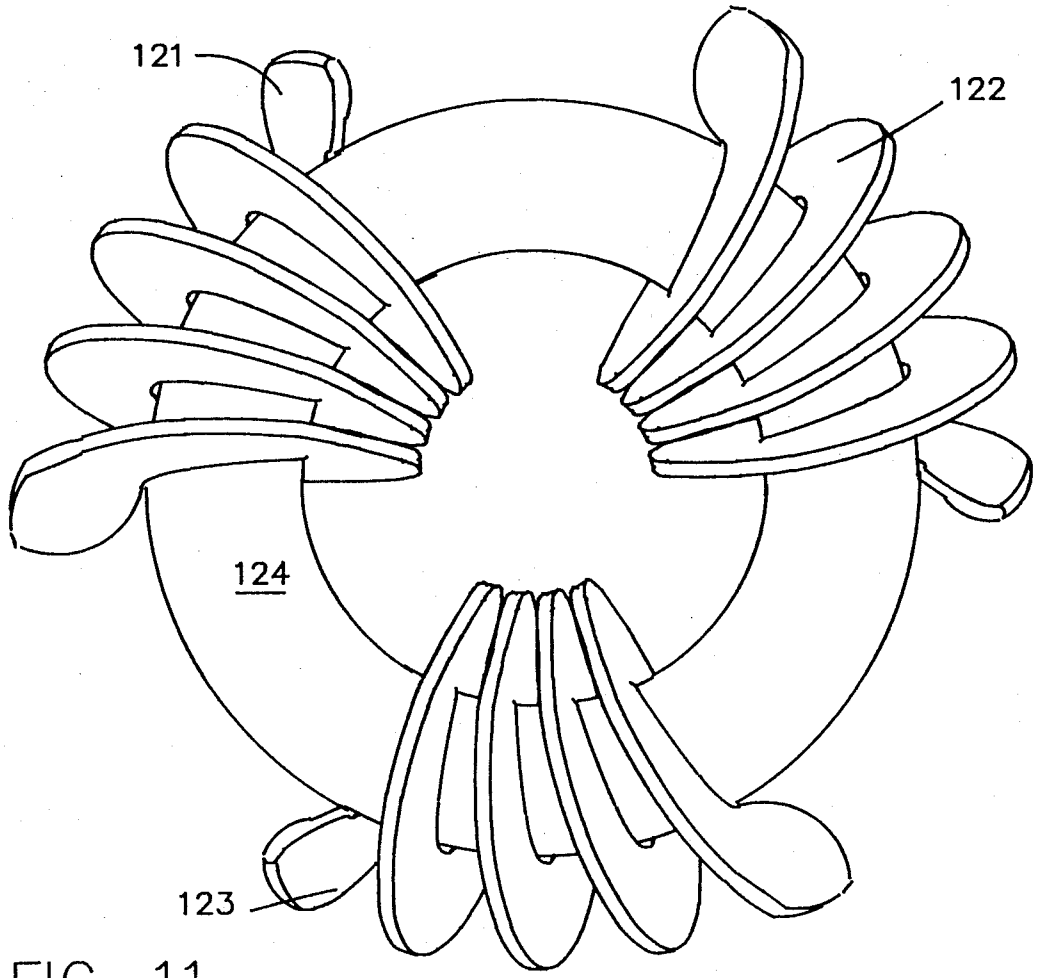
FIG. 11 shows a toroidal core with three helical coils thereon.

FIG. 11 snows helical coils 121, 122 and 123 at spaced apart locations on toroidal core 124. These segment discrete windings are primarily for high voltage applications, and, again no taping is required and the other advantages outlined are obtained.

Figure 12:
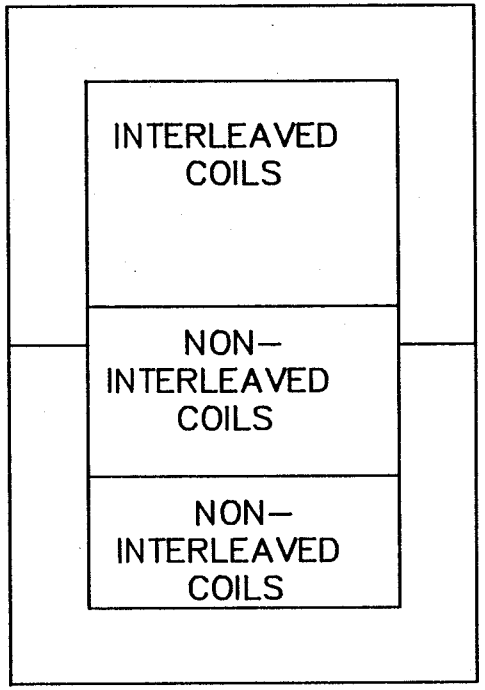
FIG. 12 is a block diagram of two single stacked coils with two interleaved coils thereabove.
Figure 13:
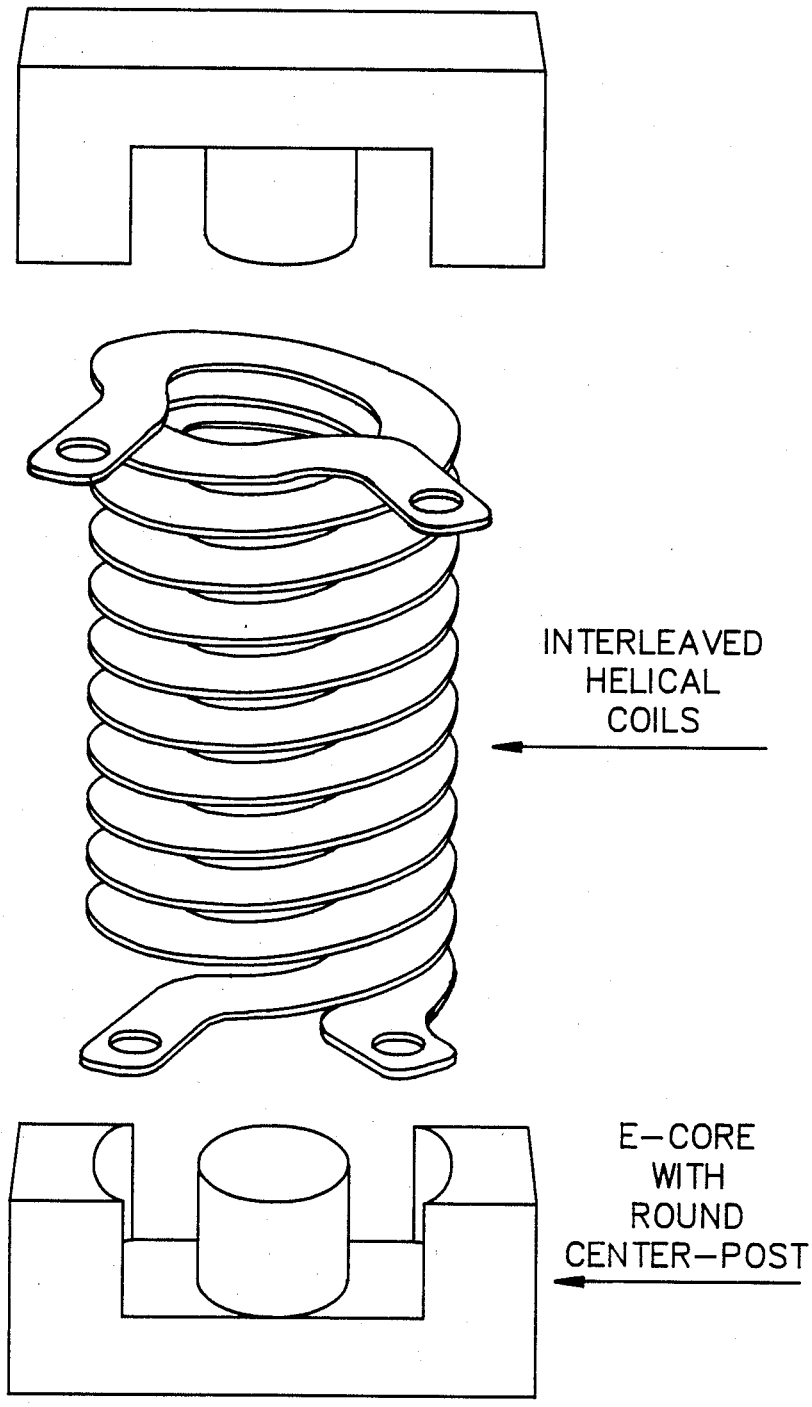
FIG. 13 is an exploded view, in perspective showing a pair of interleaved helical coils relative to upper and lower E core halves, and, FIG. 14 snows a plurality of coils on a C—C or U—U shaped core.
Figure 14:
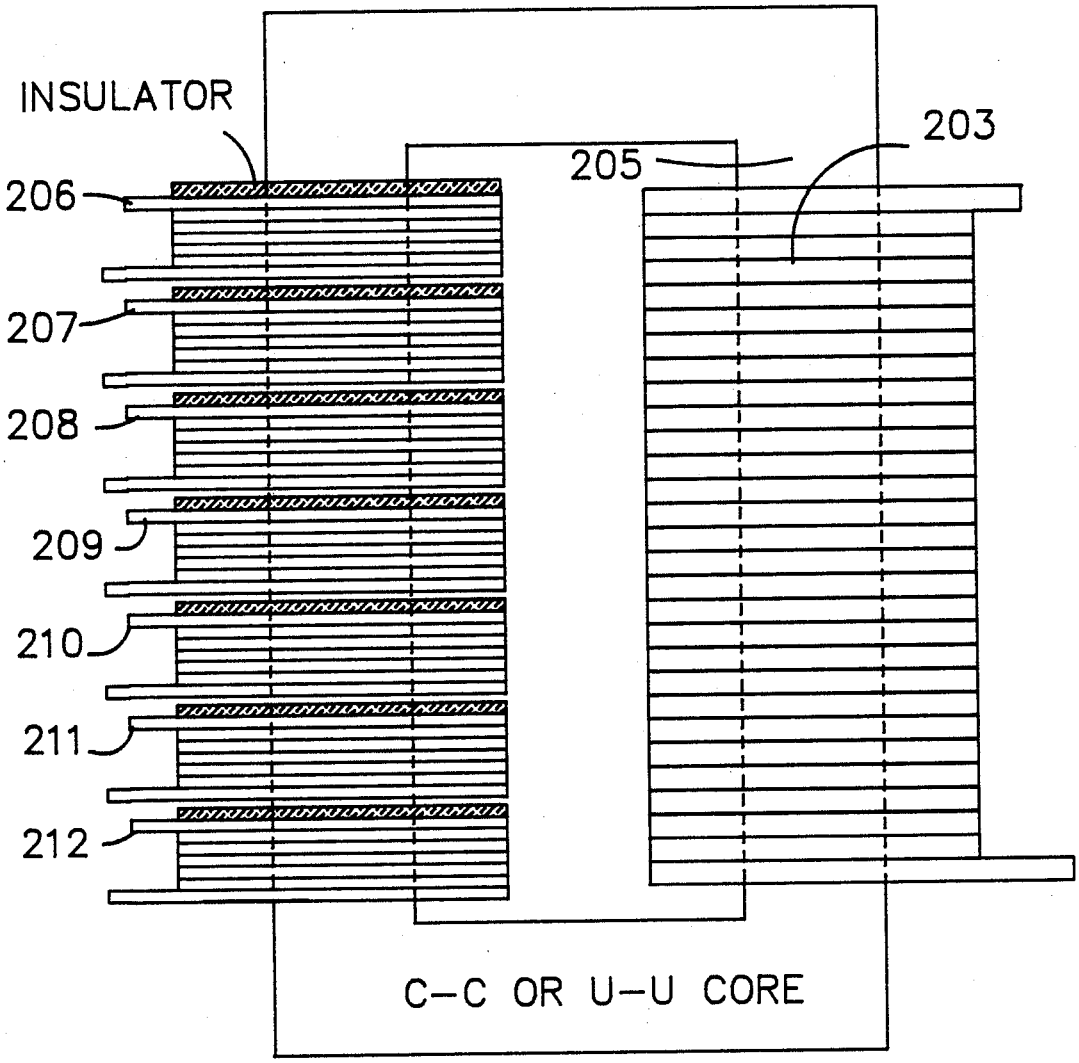

In FIG. 12, the upper INTERLEAVED COILS take the form of the interleaved helical coils of FIG. 13 whereas the two NON-INTERLEAVED COILS may correspond to the upper two coils 206, 207 of FIG. 14, except they are on a centerpost like the coils of FIG. 14.

FIG. 13 is an exploded view showing two interleaved helical coils 157 and 158 relative to upper and lower E core halves. When the core halves are mated and secured together, the coils are compressed.

In FIG. 14, a U—U or C—C shaped core 201 supports a single helical coil on leg 205 for inductive coupling with seven helical coils 206–212. This core, or the others herein, may be very large, having dimensions in feet or fractions thereof rather than inches and carrying up to dozens of coils, as shown herein.

I claim:

1. A multiple winding magnetic core inductor comprising in combination:

a core comprising a substantially closed magnetic path about a core window;

a plurality of continuous, monolithic helix coils of insulated flat metal ribbon having a width greater than the thickness and forming at least two insulated stacked turns having a first integral end, a second integral end and a central opening; said central opening of each said coil being provided to receive a central leg of said magnetic core, each of said first and second integral ends on each tabs, coil comprising respective elongated integral each said turn being uniformly coated with an insulating envelope to comprise said insulated turns;

said core having at least two outer legs, each outer leg having an inner portion thereof bordered by vertical edges, said inner portions facing said central leg in opposing relation to receive the outer perimeter of each of said helix coils, said opposing vertical edges forming the side borders of the core window through which said elongated integral tabs exit said core and respective coils normal to the plane of said window, said elongated tabs being parallel and offset inwardly from a direction tangential to its respective coil central opening;

each end of each of said helix coils comprising an unwound elongated integral tab exiting its respective helix coil in said direction offset inwardly from said direction tangential to said central opening;

the offset position of the tabs locates the inner edges of said elongated tabs, which edges, if extended, in the direction of said coil central opening define chords of the coil central opening rather than tangents to said central opening;

each of said elongated tabs has a decreased width and cross sectional area relative to the width and cross sectional area of the turns, and, each of said helix coils being compact, comprising n+1 turns but characterized by a height substantially equal to the height of a similar uncompacted coil of n turns.

2. The multiple winding magnetic core inductor of claim 1 wherein each of said inner portions of said outer leg is characterized by a concentric surface relative to said central opening of said coil.

3. The magnetic core inductor of claim 1 wherein each of said outer legs is characterized by a rectangular cross section.

4. The multiple winding inductor of claim 1 wherein: all tabs are spaced apart and exit the core generally in the same direction.

* * * * *